US007344405B2

(12) United States Patent
Izuchi et al.

(10) Patent No.: US 7,344,405 B2
(45) Date of Patent: Mar. 18, 2008

(54) ELECTRO-ACOUSTIC TRANSDUCER WITH HOLDER

(75) Inventors: Toshiro Izuchi, Fukuoka (JP); Ryuji Awamura, Fukuoka (JP)

(73) Assignee: Hosiden Corporation, Osaka (JP)

( * ) Notice: Subject to any disclaimer, the term of this patent is extended or adjusted under 35 U.S.C. 154(b) by 0 days.

(21) Appl. No.: 11/366,776

(22) Filed: Mar. 1, 2006

(65) Prior Publication Data

US 2006/0199425 A1 Sep. 7, 2006

(30) Foreign Application Priority Data

Mar. 2, 2005 (JP) ..... 2005-057456

(51) Int. Cl.
*H01R 3/00* (2006.01)

(52) U.S. Cl. ..... 439/500; 439/620.25

(58) Field of Classification Search ..... 439/68, 439/500, 620.25, 271
See application file for complete search history.

(56) References Cited

U.S. PATENT DOCUMENTS 5,586,907 A * 12/1996 Frantz et al. ..... 439/500
5,830,007 A * 11/1998 Fry et al. ..... 439/500
6,244,886 B1 * 6/2001 Strang et al. ..... 439/271
6,570,992 B1 * 5/2003 Folan et al. ..... 381/365
6,776,626 B2 * 8/2004 Huang et al. ..... 439/76.1
7,128,599 B1 * 10/2006 Ho ..... 439/500
2005/0002538 A1 1/2005 Yonchara et al.

FOREIGN PATENT DOCUMENTS

EP 0 706 301 4/1996
EP 0 901 308 3/1999
JP 403049178 A * 3/1991 ..... 439/68
JP 05-048234 2/1993
JP 10-233828 9/1998

* cited by examiner

*Primary Examiner*—Thanh-Tam Le
(74) *Attorney, Agent, or Firm*—David N. Lathrop, Esq.; Gallagher & Lathrop

(57) ABSTRACT

An electro-acoustic transducer, for example a microphone, with a holder is provided with a block-shaped holder having on the front face a housing chamber housing a microphone main body with its acoustic holes situated on the external face, the microphone main body housed in the housing chamber, a plurality of connection electrodes connected to a plurality of terminal electrodes formed on the microphone main body, respectively, and a plurality of mounting electrodes exposed at each of a front face, a back face and a rear end face in correspondence with the plurality of connection electrodes.

10 Claims, 13 Drawing Sheets

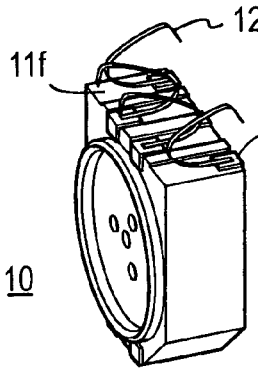
FIG. 9A
FIG. 9B
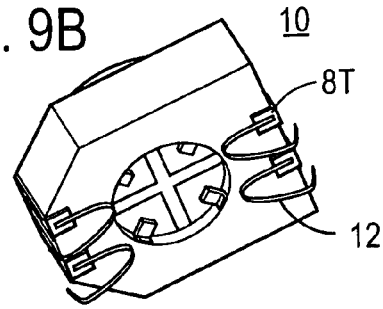
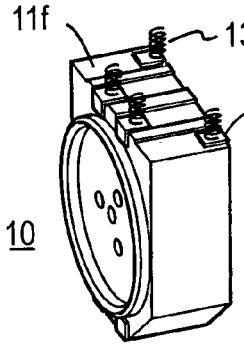
FIG. 9C
FIG. 9D
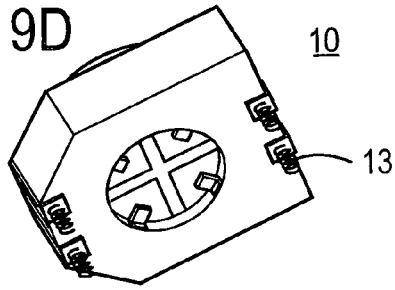
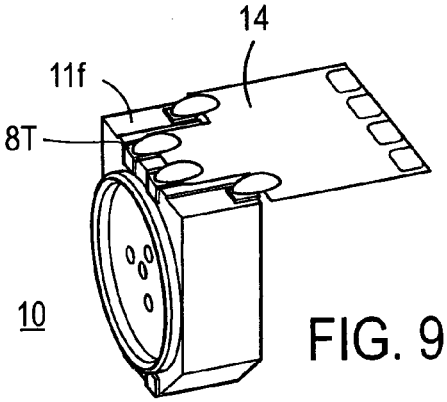
FIG. 9E
FIG. 9F
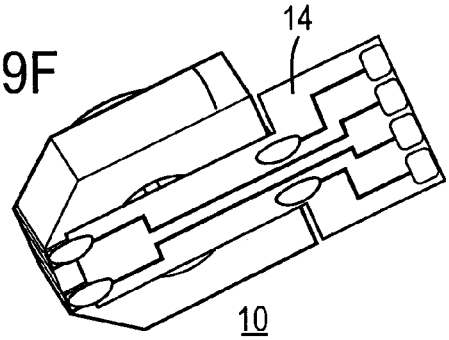
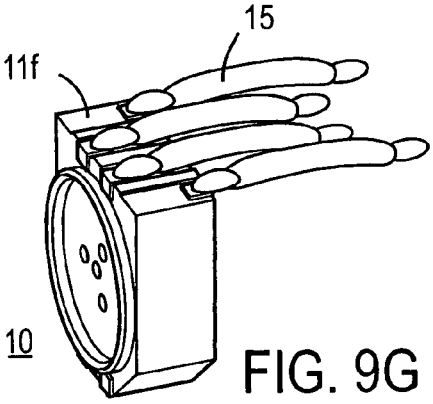
FIG. 9G
FIG. 9H
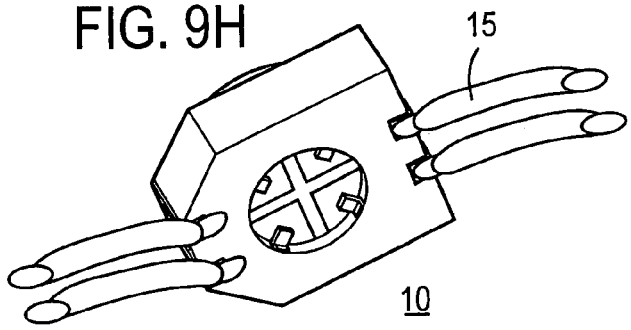

ELECTRO-ACOUSTIC TRANSDUCER WITH HOLDER

BACKGROUND OF THE INVENTION

1. Field of the Invention

The present invention relates to an electro-acoustic transducer with a holder which is incorporated in an electronic device, for example a small-sized microphone with a holder, a receiver with a holder and a sounder with a holder, which are incorporated in portable electronic devices such as personal computers, mobile phones and pagers.

2. Description of the Related Art

For conventional techniques, Japanese Patent Application Laid-Open No. H10-233828 (hereinafter referred to as Patent Document 1) discloses, as a small-sized microphone incorporated in, for example, a mobile phone, a microphone holder having a structure in which a microphone is surrounded by a rubber except for acoustic holes for prevention of occurrence of howling and vibratory noises. Japanese Patent No. 3000742 (hereinafter referred to as Patent Document 2) discloses an implementation method in which a microphone unit and a jumper wire of a board are linked together and the position of attachment of the microphone unit is adjusted with the jumper wire as an axis.

However, any of conventional techniques as represented by the aforementioned Patent Documents 1 and 2 does not disclose a technique in which a microphone folder housing a microphone is adapted so that the microphone can be placed in, for example, a vertical position or a horizontal position. Thus, a microphone holder exclusively for placement in a vertical position is required if the microphone is to be placed in a vertical position, and a microphone holder exclusively for placement in a horizontal position if the microphone is to be placed in a horizontal position.

Thus, with a change in mounting position of the microphone associated with a change in the type of, for example, mobile phone, it is desired to provide a universal microphone with a holder capable of accommodating a change in mounting position by forming a microphone capable of accommodating various position changes.

SUMMARY OF THE INVENTION

The present invention has been made in view of the aforementioned problem, and its object is to provide a universal electro-acoustic transducer with a holder capable of accommodating various position changes.

The electro-acoustic transducer with a holder according to the invention comprises:

an electro-acoustic transducer having a plurality of terminal electrodes;

a block-shaped holder which has a plurality of faces and in which a housing chamber having an opening on one of the faces and housing the electro-acoustic transducer is formed;

a plurality of connection electrodes provided on the bottom wall surface of the housing chamber and connected to the plurality of terminal electrodes, respectively;

a plurality of mounting electrodes provided on the plurality of faces of the holder in correspondence with the plurality of connection electrodes, respectively; and a wiring portion provided on the holder and electrically connecting the connection electrodes to the corresponding mounting electrodes on the plurality of faces.

BRIEF DESCRIPTION OF THE DRAWINGS

FIG. 9A is a perspective view of the holder having flat springs attached to electrodes on the rear end face of the holder;

FIG. 9B is a perspective view of the holder having flat springs attached to electrodes on the back face of the holder;

FIG. 9C is a perspective view of the holder having coiled springs attached to electrodes on the rear end face of the holder;

FIG. 9D is a perspective view of the holder having coiled springs attached to electrodes on the back face of the holder;

FIG. 9E is a perspective view of the holder having a flexible print wiring board attached to electrodes on the rear end face of the holder;

FIG. 9F is a perspective view of the holder having a flexible print wiring board attached to electrodes on the back face of the holder;

FIG. 9G is a perspective view of the holder having lead wires attached to electrodes on the rear end face of the holder;

FIG. 9H is a perspective view of the holder having lead wires attached to electrodes on the back face of the holder;

DETAILED DESCRIPTION OF THE PREFERRED EMBODIMENTS

First Embodiment

Figure 1A:
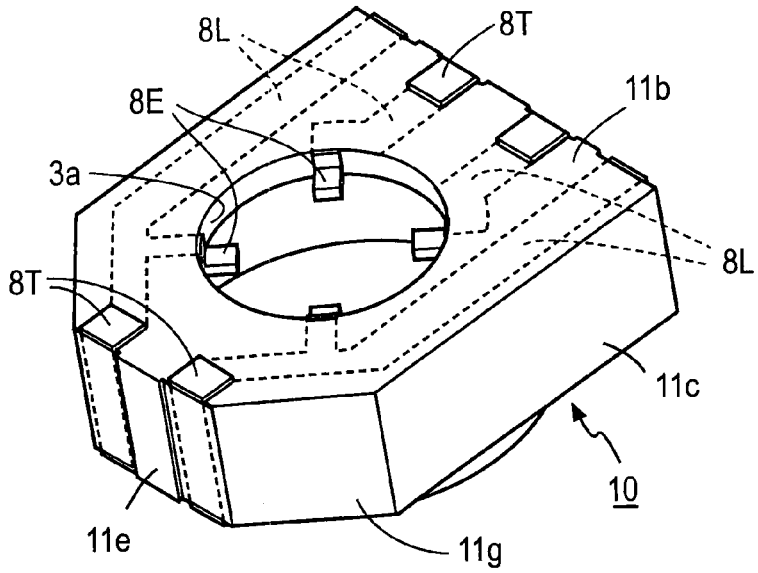
FIG. 1A is a perspective view showing a holder of a microphone with a holder as a first embodiment of this invention.
Figure 1B:
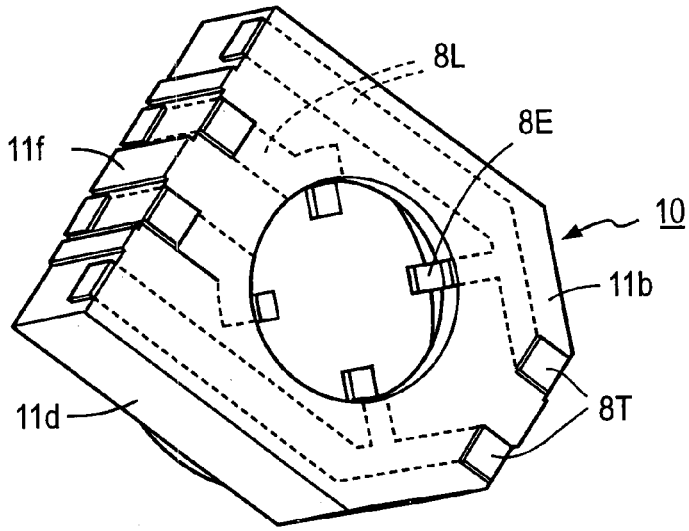
FIG. 1B is a perspective view of the holder in the first embodiment seen from a perspective different from that in FIG. 1 A.
Figure 1C:
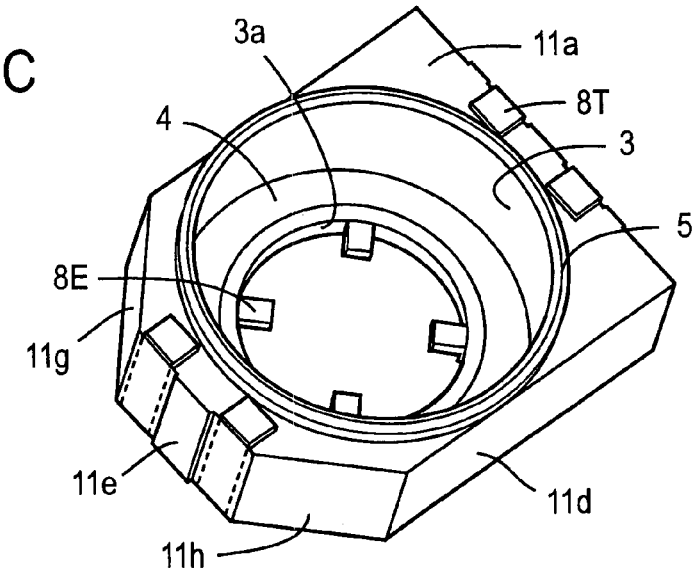
FIG. 1C is a perspective view of the holder in the first embodiment seen from a further different perspective.

FIGS. 1A, 1B and 1C are perspective views of a holder of a microphone with a holder (hereinafter referred to as microphone assembly) as a first embodiment of an electro-acoustic transducer with a holder according to this invention, seen from different perspectives. The holder 10 is formed from a heat-resistant elastic material such as a silicon rubber in almost a block shape as a whole, and has a front face (top face) 11*a* and a back face 11*b* opposite in parallel to each other, side faces 11*c* and 11*d* perpendicular to the front face and back face and opposite in parallel to each other, and a front end face 11*e* and a rear end face 11*f* perpendicular to the front face, back face and side faces and opposite in parallel to each other.

In this example, further, slanting faces 11*g* and 11*h* are formed so as to cut off ridges at which the side faces 11*c* and 11*d* cross the front end face 11*e* for showing the orientation of the holder 10. The holder 10 made of a heat-resistant resin allows a soldering process in a reflow tank, and terminal electrodes 27 of a microphone main body 20, which will be described later as, for example, the electro-acoustic transducer, and connection electrodes 8 can be soldered by a reflow process. The reason why the holder 10 is made of an elastic material is that it can be deformed to fit in a housing space for attaching the electro-acoustic transducer to an electronic device. Further, adhesiveness of an annular sealing portion of the holder 10 to an inner wall surface of a housing of a mobile phone is improved so as to secure a capability of sealing an acoustic space formed between the front face of the microphone main body 20 and the inner wall surface of the housing as will be described later. In addition, an elastic material having an insulating property such as a silicon rubber can ensure insulation between wiring portions or mounting electrodes, and between the microphone main body and other parts.

Figure 2A:
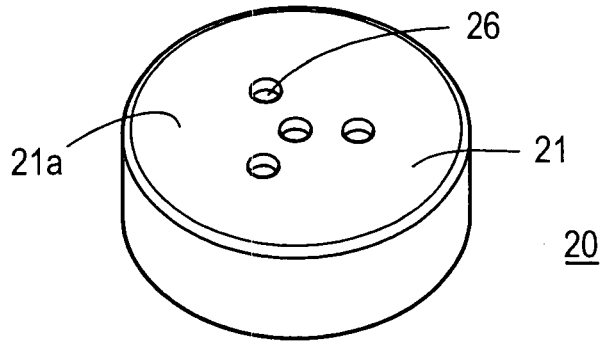
FIG. 2A is a perspective view illustrating a microphone main body in the first embodiment.
Figure 2B:
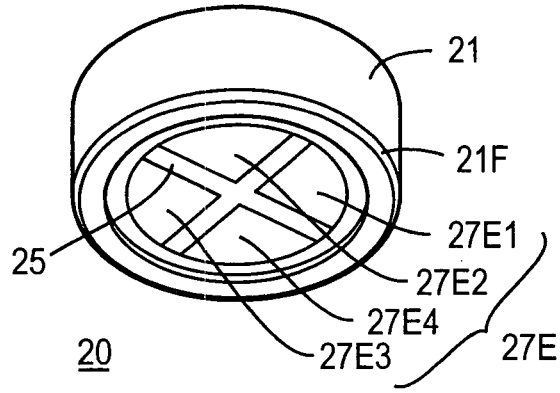
FIG. 2B is a perspective view of the microphone main body in the first embodiment seen from a perspective different from that in FIG. 2A.

The holder 10 has a cylindrical housing chamber 3 having an opening in its front face 11*a* in accordance with the shape (flat cylindrical shape in this case) of the microphone main body 20 shown in, for example, FIGS. 2A and 2B and extending to near the back face 11*b*. A hole 3*a* which is concentric with the housing chamber 3 and has a diameter smaller than the diameter of the microphone main body 20 is formed in a bottom wall 4 on the back face 11*b* side of the housing chamber 3. On the bottom wall 4, four connection electrodes 8E are mounted at equal angular intervals along the circumference of the hole 3*a* such that they enter toward the center of the hole 3*a*. On the front face 11*a* of the holder 10, an annular sealing portion 5 is saliently formed to surround the housing chamber 3. The hole 3*a* is used for a task of establishing connection between the connection electrodes 8E and terminal electrodes of the microphone main body 20 described later, for example.

The microphone main body 20 shown in FIGS. 2A and 2B is housed in the housing chamber 3. The microphone main body 20 has a cylindrical case 21 whose front face 21*a* is closed, and a board 25 which is fitted in the case to close the rear face of the case 21. Acoustic holes 26 are formed in the front face 21*a* of the case 21. The board 25 is fixed to the case 21 by caulked portion 21F of the case.

The microphone main body 20 is housed such that the front face 21*a* of the microphone 20 in which acoustic holes 26 are formed is situated on the same level as the front face 11*a* of the holder 10, and the board 25 of the microphone main body 20 is situated on the bottom wall 4 side. The microphone main body 20 shown in FIGS. 2A and 2B has four terminal electrodes 27E1, 27E2, 27E3 and 27E4, and so far as a digital electret condenser microphone is concerned, the terminal electrodes 27E have four terminals for electric power source, earth, output signal and clock. In the case of a conventional digital electret condenser microphone, this number of electrodes is sufficient for the number of terminals such as three terminals for electric power source, earth and output signal, or two terminals for earth and output signal.

Referring to FIGS. 1A, 1B and 1C again, on the holder 10, a plurality of connection electrodes 8E (four electrodes in the figure) in contact with the terminal electrodes 27E of the microphone main body 20 are placed saliently from the bottom wall 4 with the microphone main body 20 housed in the housing chamber 3, and a plurality of wiring portions 8L are extended from the connection electrodes 8E and coupled to a plurality of corresponding mounting electrodes 8T. Namely, the connection electrodes 8E are connected by the corresponding wiring portions 8L to four mounting electrodes 8T exposed on each of the front face 11*a*, the back face 11*b* and the rear end face 11*f* (the details of the wiring portions will be described later with reference to FIG. 3).

Corresponding ones of the connection electrodes 8E, wiring portions 8L and mounting electrodes 8T are integrally formed of, for example, a SUS plate or brass plate plated with gold, by punching and folding. The integrated piece of the punched-and-folded connection electrode 8E, wiring portion 8L and mounting electrodes 8T shown in FIGS. 1A and 1B can be held on the holder 10 by, for example, insert molding with a silicon rubber. In FIGS. 1A and 1B, although the wiring portion 8L is shown by a dashed line for illustrating the state of connection of the connection electrode 8E, the wiring portion 8L and the mounting electrode 8T, the area of the wiring portions 8L is actually embedded in the silicon rubber forming the holder 10 by insert molding. Thus, the wiring portion would not be detached even if the holder 10 having elasticity undergoes more or less elastic deformation.

Figure 3:
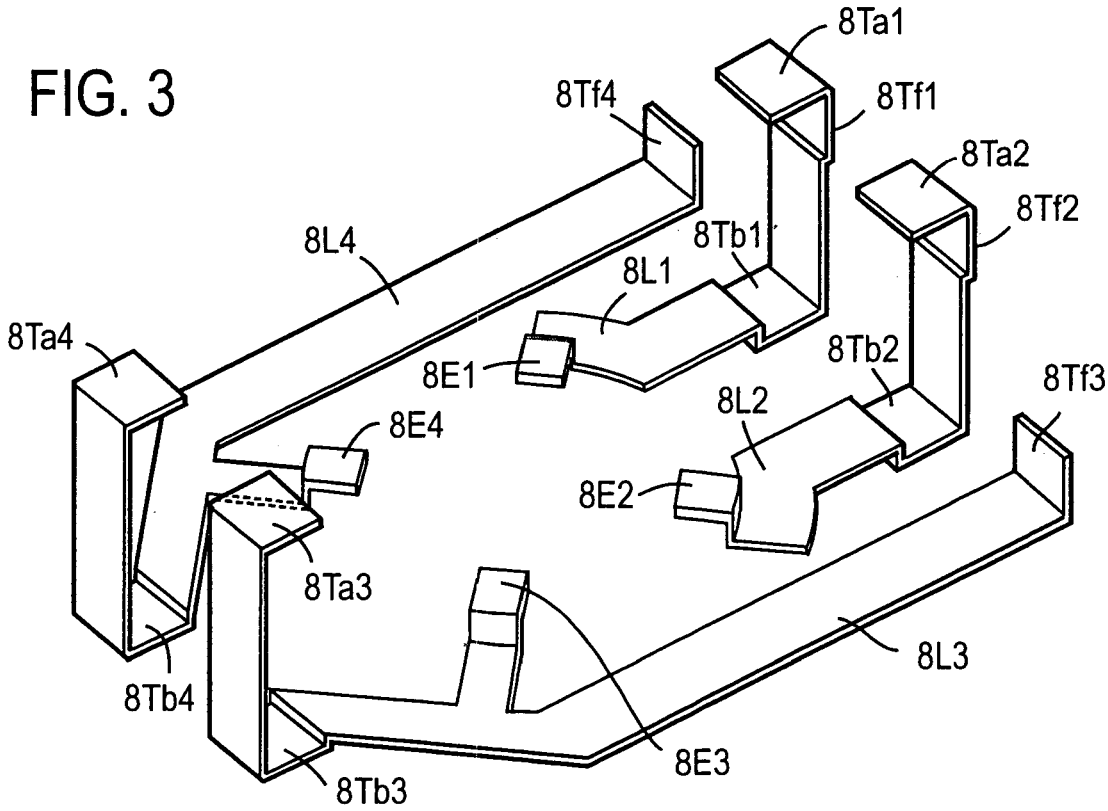
FIG. 3 is a perspective view showing an example of the configuration of electrodes and a wiring portion.

FIG. 3 shows a set of the connection electrode 8E, the wiring portion 8L and a plurality of mounting electrodes 8T formed as an integrated piece by punching/folding, in correspondence with each connection electrode 8E. In FIG. 3, FIGS. 4A to 4E and FIGS. 5A and 5B, four connection electrodes 8E are denoted by reference symbols 8E1, 8E2, 8E3 and 8E4, respectively, four wiring portions 8L are denoted by reference symbols 8L1, 8L2, 8L3 and 8L4, respectively, and a plurality of mounting electrodes 8T connected to the wiring portions are denoted by reference symbols 8Ta1, 8Tb1 and 8Tf1; 8Ta2, 8Tb2, 8Tf2, 8Ta3, 8Tb3 and 8Tf3; and 8Ta4, 8Tb4 and 8Tf4.

On the back face 11*b* of the holder 10 (also see FIGS. 1A and 1B), two wiring portions 8L3 and 8L4 span from the rear end face 11*f* to the front end face 11*e*, and further, the wiring portions 8L3 and 8L4 rise from the front end face 11*e* and extend to the front face 11*a*. On the back face 11*b* of the holder 10, two wiring portions 8L1 and 8L2 span from the edge of the bottom wall 4 to the rear end face 11*f*, and the wiring portions 8L1 and 8L2 rise from the rear end face 11*f* and extend to the front face 11*a*. The mounting electrodes 8Tf4, 8Ta4 and 8Tb4 are formed in a bent form at opposite ends and some midpoint of the wiring portion 8L4, the mounting electrodes 8Tf3, 8Ta3 and 8Tb3 are formed as bent portions at opposite ends and same midpoint of the wiring portion 8L3, the mounting electrodes 8Ta1, 8Tf1 and 8Tb1 are formed as bent portions at an end and two midpoints of the wiring portion 8L1, and the mounting electrodes 8Ta2, 8Tf2 and 8Tb2 are formed as bent portions at an end and two midpoints of the wiring portion 8L2.

As a result, the four mounting electrodes 8Ta4, 8Ta3, 8Ta1 and 8Ta2 are situated on the front face 11*a* of the holder 10, the four mounting electrodes 8Tf4, 8Tf3, 8Tf1 and 8Tf2 are situated on the rear end face 11*f*, and the four mounting electrodes 8Tb4, 8Tb3, 8Tb1 and 8Tb2 are situated on the back face 11*b* of the holder 10. The mounting electrodes 8Ta4 and 8Ta1, 8Ta3 and 8Ta2, 8Tb4 and 8Tb1, and 8Tb3 and 8Tb2 are situated opposite to each other, respectively, with one situated on the front end face 11*e* side and the other situated on the rear end face 11*f* side. The reason why the mounting electrodes 8Ta1, 8Ta2, 8Tb1 and 8Tb2 are placed on the rear end face 11*f* side, the mounting electrodes 8Ta4, 8Ta3, 8Tb4 and 8Tb3 are placed on the front end face 11*e* side, the mounting electrodes 8Tf1 and 8Tf2 are placed on the front face 11*a* side, and the mounting electrodes 8Tf4 and 8Tf3 are placed on the back face side is that stability of placement of the holder 10 is ensured by placing the mounting electrodes such that they are at a significant distance from one another. Thus, as long as stability of placement of the holder 10 can be ensured, for example, the mounting electrodes 8Tf1 and 8Tf2 may be formed to adjoin the mounting electrodes 8Tb1 and 8Tb2 so as to match the mounting electrodes 8Tf4 and 8Tf3, or the mounting electrodes 8Tb4 and 8Tb3 may be formed to adjoin the mounting electrodes 8Tf4 and 8Tf3 so as to match the mounting electrodes 8Tb1 and 8Tb2.

At ends of branches extended from some midpoints of the wiring portions 8L4 and 8L3 and at ends of the wiring portions 8L1 and 8L2, the wiring portions 8L4, 8L3, 8L1 and 8L2 rise along the edge of the hole 3*a* from the back face 11*b* of the holder 10, and are coupled to the connection electrodes 8E4, 8E3, 8E1 and 8E2 at the front of the bottom wall 4.

FIGS. 4A to 4E show the left side view, the top view, the right side view, the front view and the back view of the holder 10 on which four integrated pieces each comprised of the wiring portion 8L, the connection electrode 8E and three mounting electrodes 8T are mounted. Thus, four electrodes 8E1 to 8E4 are provided as connection electrodes 8E, four wiring portions 8L1 to 8L4 are provided as wiring portions 8L, and four sets of mounting electrodes 8Ta1, 8Tb1 and 8Tf1; 8Ta2, 8Tb2 and 8Tf2; 8Ta3, 8Tb3 and 8Tf3; and 8Ta4, 8Tb4 and 8Tf4.

In FIGS. 4A to 4E, slight irregularities are formed on the surface of the rear end face 11*f* of the holder 10. Specifically, areas other than the wiring portions 8L1 and 8L2 and mounting electrodes 8Tf3 and 8Tf4 are formed into slightly raised portions 11*fp* so that the holder 10 can remain upright stably before and during soldering of the mounting electrodes 8Tf1-8Tf4 on the rear end face 11*f* to a circuit board (not shown) when the holder 10 is to be mounted vertical to the circuit board. As explicitly shown in the top view of FIG. 4B (see also FIG. 5B), a raised step portion 4*a* is formed on the marginal area around the hole 3*a* on the front face side of the bottom wall 4, and by the raised step portion 4*a* having a thickness equal to or greater than the caulked portion 21F of the case 21 on the peripheral of the back face of the microphone main body 20 as in, for example, an electret condenser microphone, the terminal electrodes 27E1 to 27E4 of the microphone main body 20 are connected onto the connection electrodes to 8E1, and at the same time, the microphone main body 20 is reliably placed on the bottom wall 4.

Figure 4C:
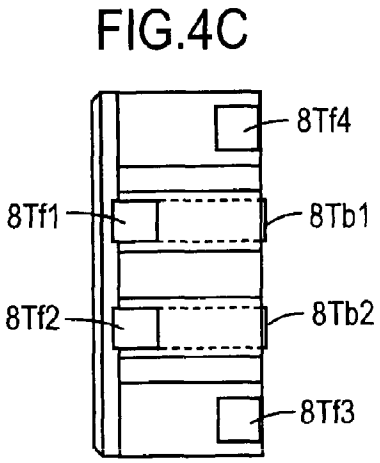
FIG. 4C is a right side view of the holder.
Figure 4B:
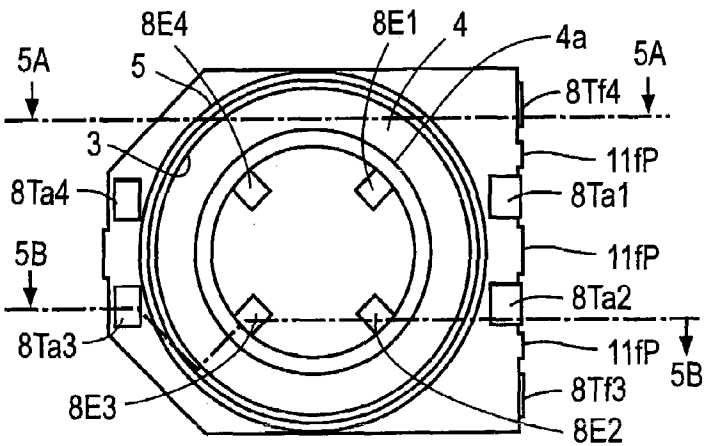
FIG. 4B is a top view of the holder.
Figure 4D:
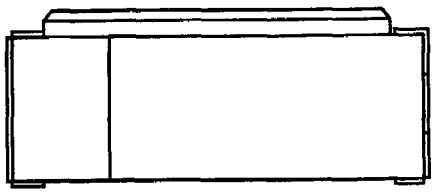
FIG. 4D is a front view of the holder.
Figure 4E:
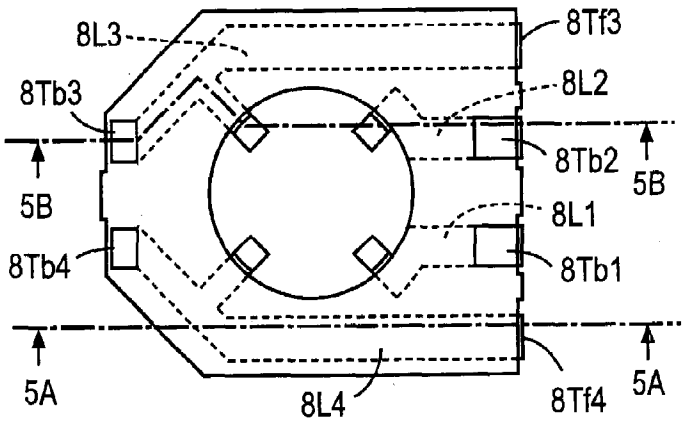
FIG. 4E is a back view of the holder.
Figure 4A:
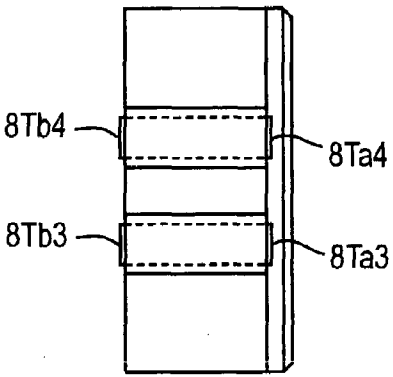
FIG. 4A is a left side view of the holder.
Figure 5A:
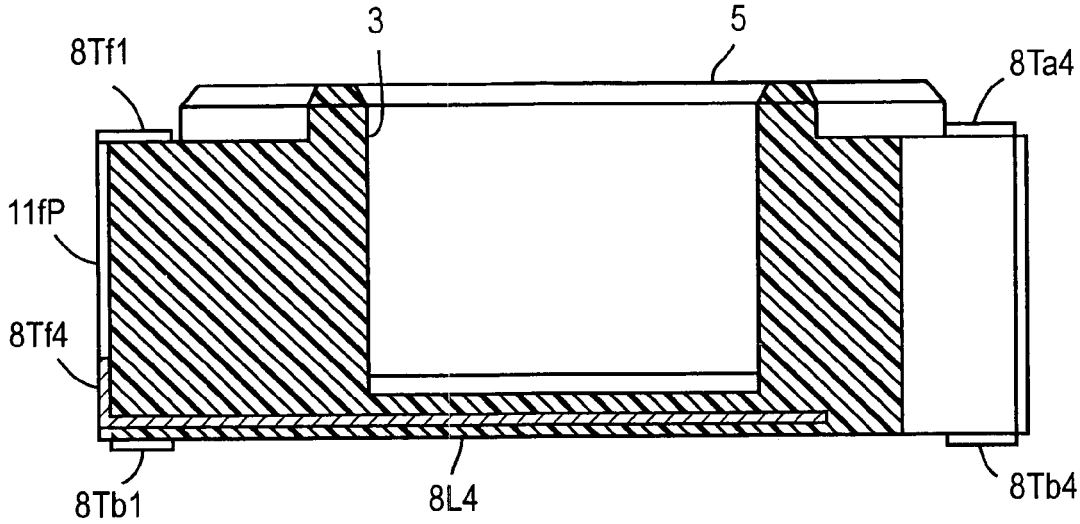
FIG. 5A is a sectional view taken along the line 5A-5A.
Figure 5B:
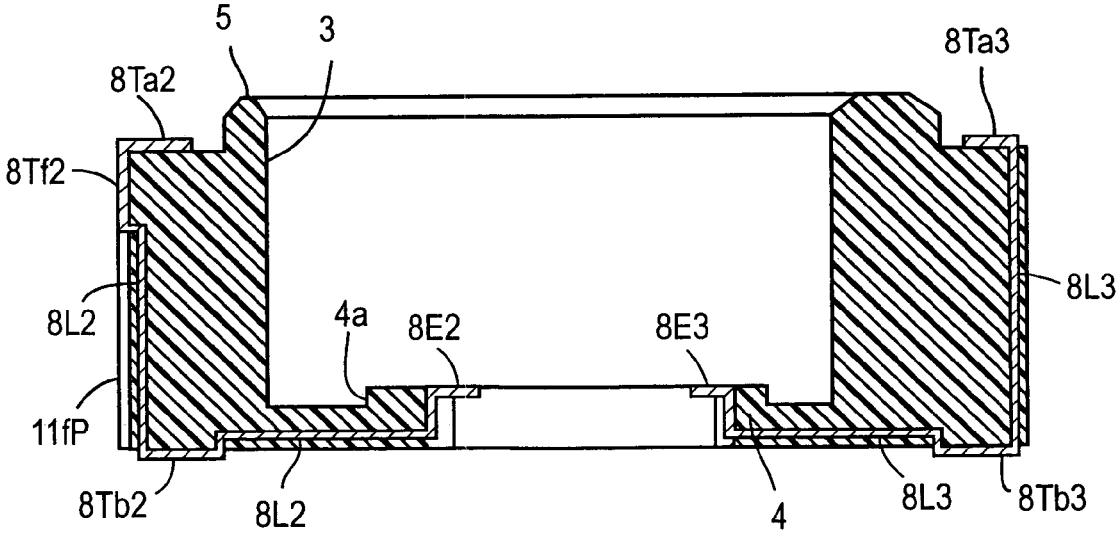
FIG. 5B is a sectional view taken along the line 5B-5B.

FIGS. 5A and 5B show a 5A-5A cross section and a 5B-5B cross section of the holder 10 in FIGS. 4B and 4E. By the 5B-5B cross section, the state of exposure of the mounting electrodes 8Ta2, 8Ta3, 8Tb2, 8Tb3 and 8Tf2, the state of arrangement of the connection electrodes 8E2 and 8E3, and the state of embedment of the wiring portions 8L2 and 8L3 are shown. By the 5A-5A cross section, the state of exposure of the mounting electrode 8Tf4 and the state of embedment of the wiring portion 8L4 are shown.

Figure 6A:
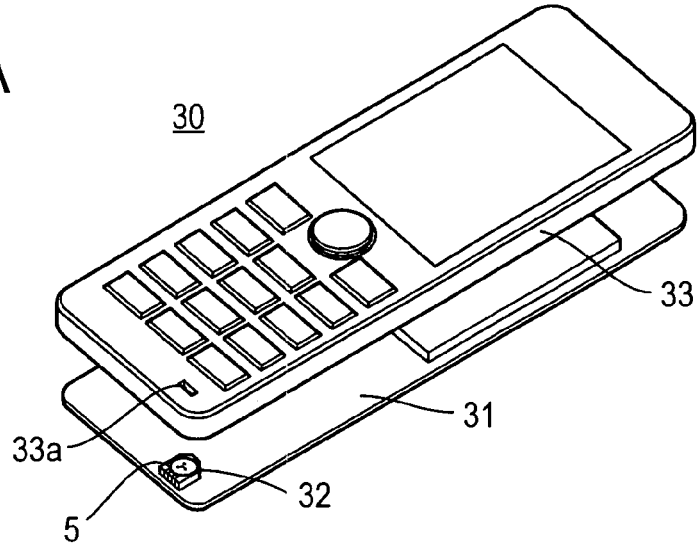
FIG. 6A is an exploded view of a mobile phone where the microphone with a holder is incorporated in a horizontal position.
Figure 6B:
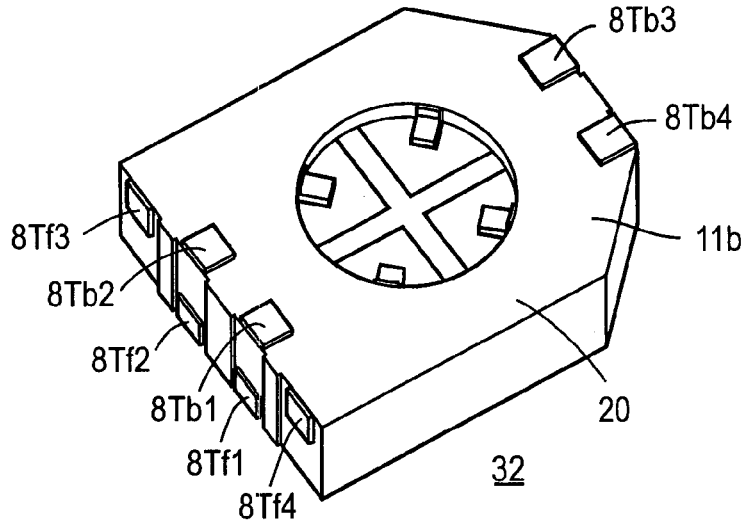
FIG. 6B is a perspective view of the holder incorporated in the mobile phone.
Figure 6C:
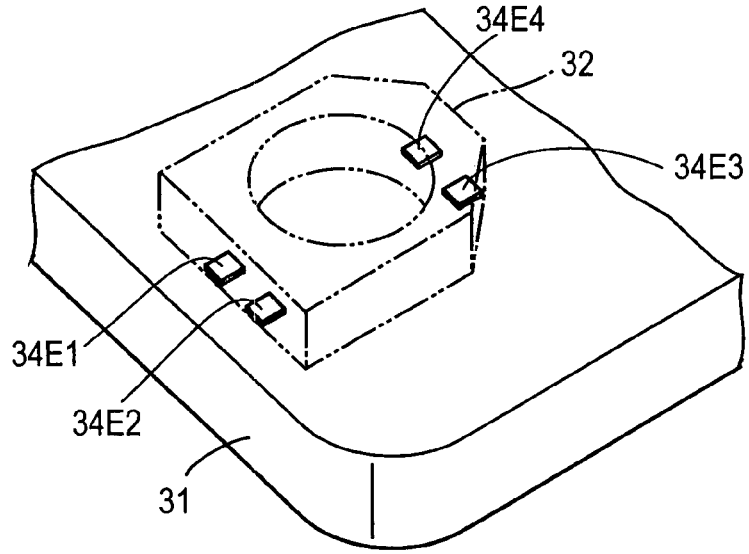
FIG. 6C is a perspective view for explaining how to connect the holder incorporated in the mobile phone.

FIGS. 6A, 6B and 6C, FIGS. 7A, 7B and 7C, and FIGS. 8A to 8D show the usage state where a microphone with a the holder, i.e., a microphone assembly is mounted on a mobile phone. FIGS. 6A, 6B and 6C show an example where the microphone assembly 32 is attached in so called a horizontal position on a circuit board 31 of the mobile phone 30. Specifically, the back face 11*b* of the holder 10 of the microphone assembly 32 is placed on the circuit board 31, and the mounting electrodes 8Tb1, 8Tb2, 8Tb3 and 8Tb4 of the holder 10 are soldered to electrodes 34E1, 34E2, 34E3 and 34E4 provided on the circuit board 31. In this case, the inner wall surface of the housing 33 presses against the sealing portion 5 of the holder 10 with the circuit board 31 covered with the housing 33 of the mobile phone 30, whereby sealing is performed. Since the sealing portion 5 is elastic, the circular tip of the sealing portion 5 tightly contacts the inner wall surface of the housing 33, thus sealing an acoustic space between the front face 21*a* of the microphone main body 20 and the inner wall surface of the housing 33 around a sound hole 33*a* formed in the housing 33.

Figure 7A:
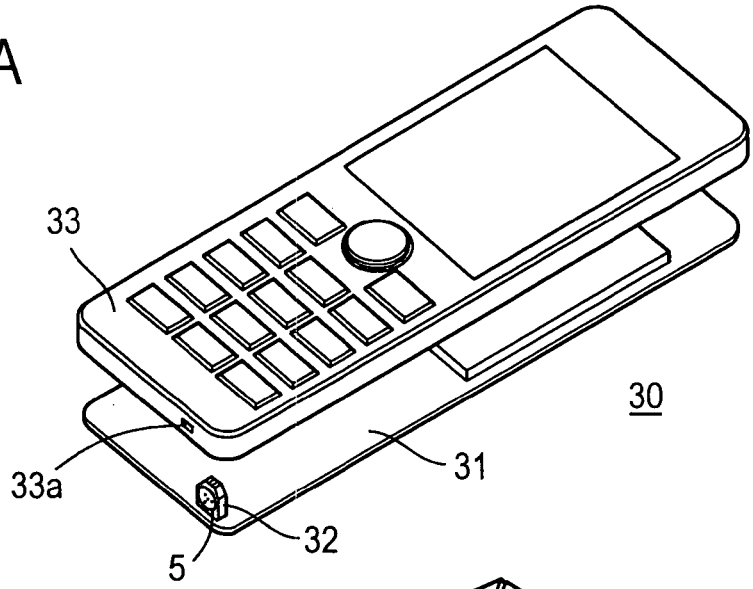
FIG. 7A is an exploded view of a mobile phone where the microphone with a holder is incorporated in a vertical position.
Figure 7B:
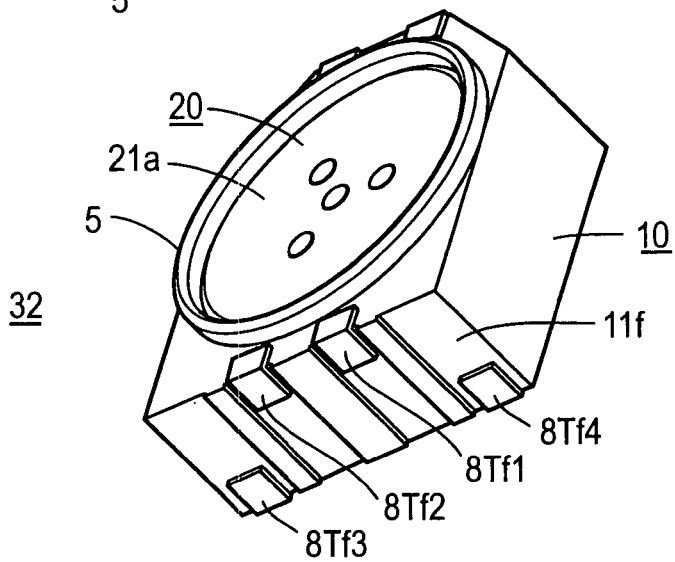
FIG. 7B is a perspective view of the holder incorporated in the mobile phone.
Figure 7C:
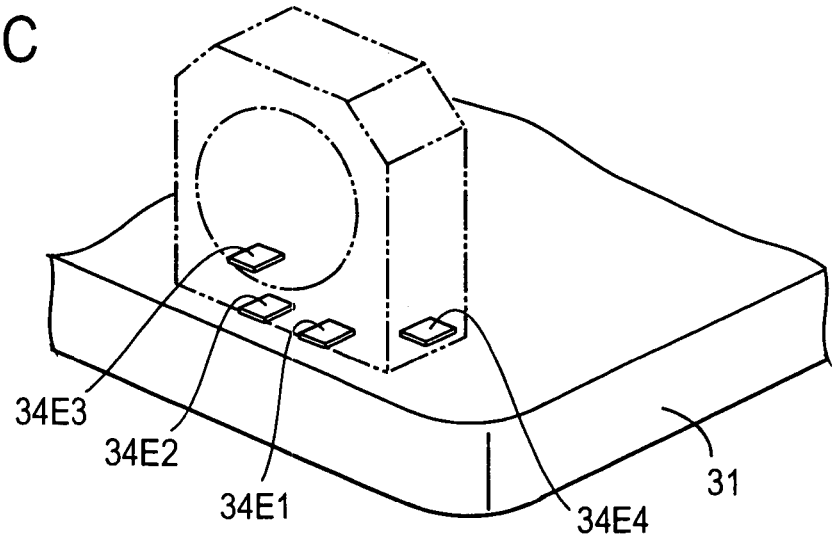
FIG. 7C is a perspective view for explaining how to connect the holder incorporated in the mobile phone.
Figure 8C:
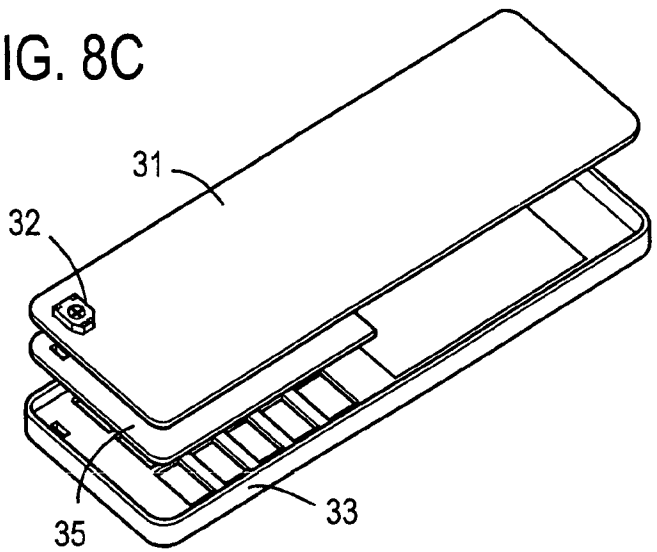
FIG. 8C is a perspective view showing an assembly of FIG. 8A with the figure flipped from top to bottom.
Figure 8D:
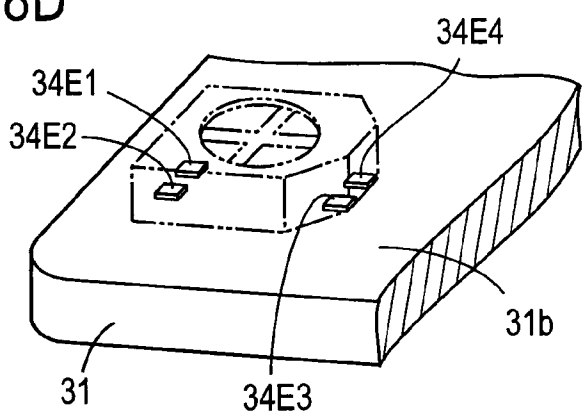
FIG. 8D is a perspective view for explaining how to connect the attached holder.
Figure 8A:
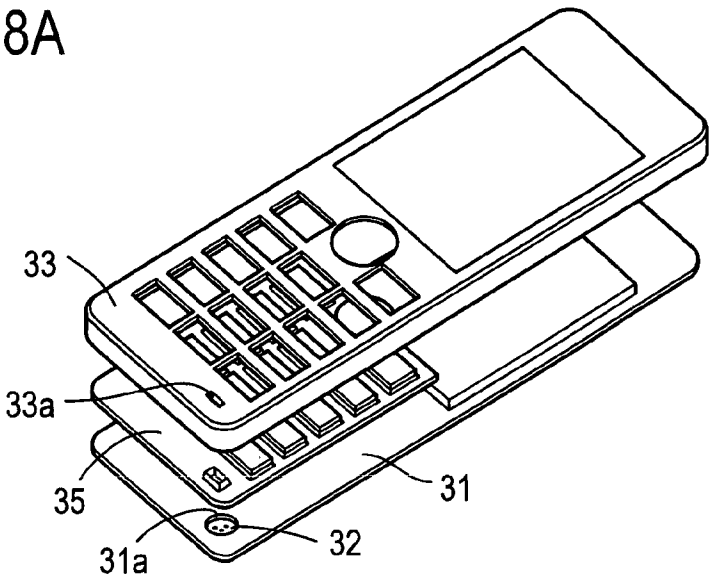
FIG. 8A is an exploded perspective view where the front face of the holder is attached from the back side of a board of the mobile phone.
Figure 8B:
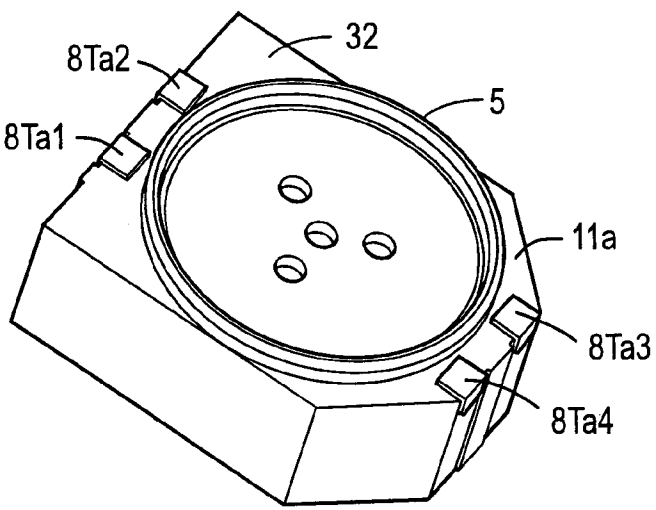
FIG. 8B is a perspective view of the holder which is attached.

FIGS. 7A, 7B and 7C show an example where the microphone assembly 32 is attached in so called a vertical position on the circuit board 31 of the mobile phone 30. Specifically, the rear end face 11*f* of the holder 10 of the microphone assembly 32 is placed on the circuit board 31, and the mounting electrodes 8Tf1, 8Tf2, 8Tf3 and 8Tf4 of the holder 10 are soldered to the electrodes 34E1, 34E2, 34E3 and 34E4 formed on the circuit board 31. In this case, an inner surface of the side wall of the housing 33 presses against the sealing portion 5 of the holder 10 with the circuit board 31 being covered with the housing 33 of the mobile phone 30, whereby sealing of the acoustic space between the front face 21*a* of the microphone main body 20 and the inner surface of the side wall is achieved. In the state of placement in a vertical position, there is an advantage that the microphone is hard to be affected by vibrations from the circuit board 31.

In FIGS. 8A to 8D, the microphone assembly 32 is attached from the back side of the circuit board 31 of the mobile phone 30, and the sealing portion 5 of the holder 10 is tightly inserted in a round hole 31*a* formed in the circuit board 31. In this case, the mounting electrodes 8Ta1 to 8Ta4 of the holder 10 are soldered to the electrodes 34E1 to 34E4 provided on the back side of the circuit board 31. A keypad 35 has a role of sealing when the circuit board 31 is covered with the housing 33 of the mobile phone 30. In the structure of attachment of the microphone assembly 32, it is possible to make effective use of the space of the housing because the microphone assembly 32 is situated on the back side of the circuit board 31.

FIGS. 6A to 6C, FIGS. 7A to 7C and FIGS. 8A to 8D show examples where the mounting electrodes of the holder 10 are soldered to the electrodes 34E1 to 34E4 of the circuit board 31, but there are various possible alterations for the manner of connection, and they include, for example, a structure in which flat springs are attached to the mounting electrodes 8T as shown in FIGS. 9A and 9B, a structure in which coiled springs 13 are attached to the mounting electrodes 8T as shown in FIGS. 9C and 9D, a structure in which terminals of a flexible print wiring board 14 are connected to the mounting electrodes 8T as shown in FIGS. 9E and 9F, and a structure in which terminals of lead wires 15 are connected to the mounting electrodes 8T as shown in FIGS. 9G and 9H. FIGS. 9A, 9C, 9E and 9G show a state in which springs and terminals are connected to the mounting electrodes 8T (8Tf1 to 8Tf4) on the rear end face 11*f* of the holder 10, and FIGS. 9B, 9D, 9F and 9H show a state in which springs and terminals are connected to the mounting electrodes (8Tb1 to 8Tb4) on the back face 11*b* of the holder 10.

Second Embodiment

Figure 10:
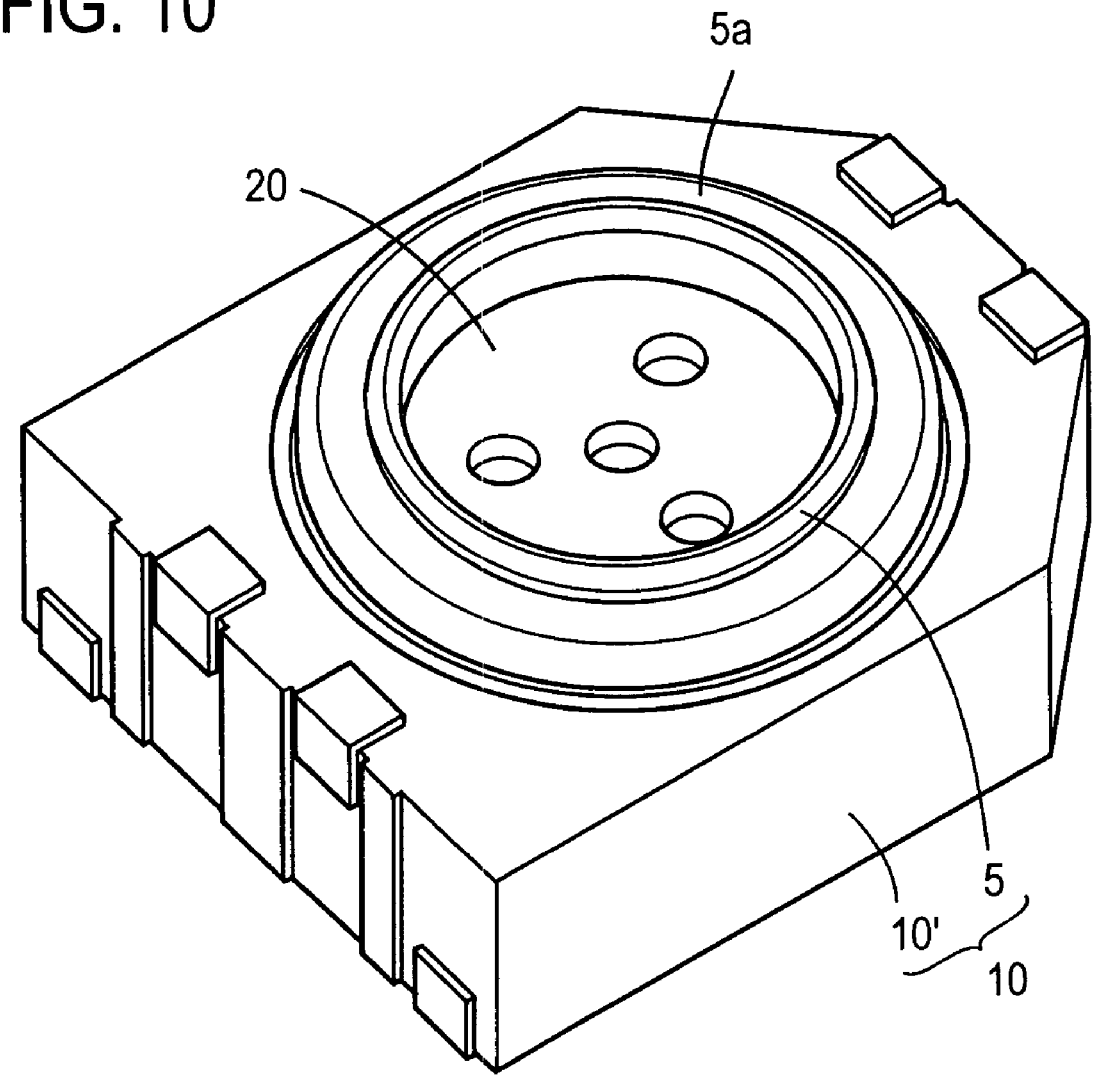
FIG. 10 is a perspective view of a microphone with a holder as a second example of this invention.
Figure 11A:
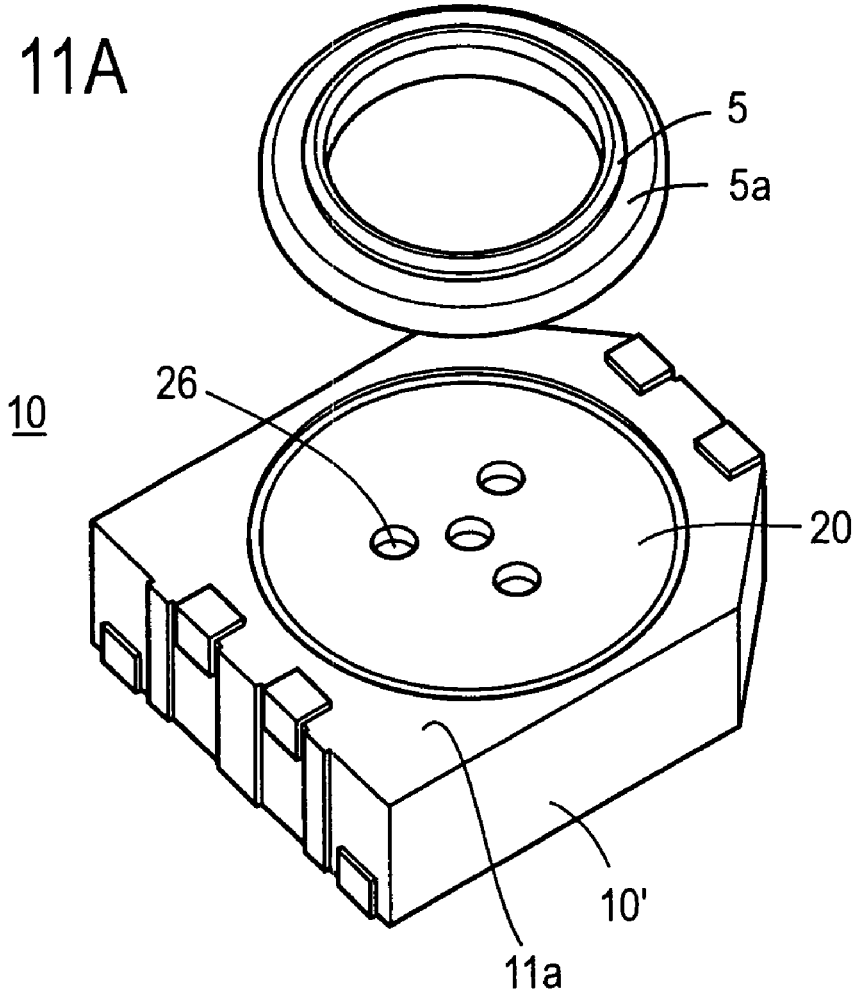
FIG. 11A is an exploded perspective view of the holder of FIG. 10.
Figure 11B:
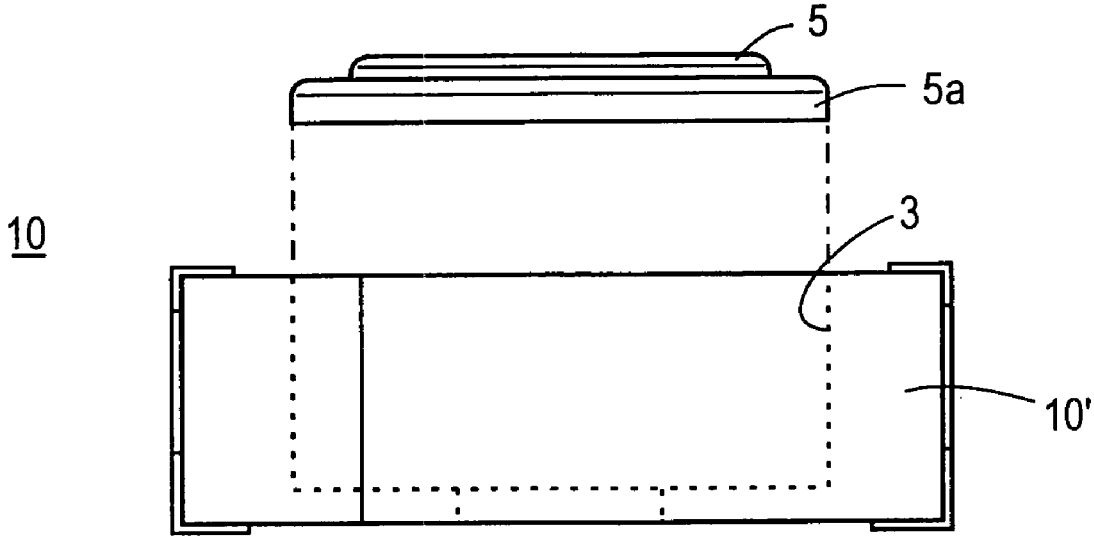
FIG. 11B is a front view of the exploded holder.
Figure 12C:
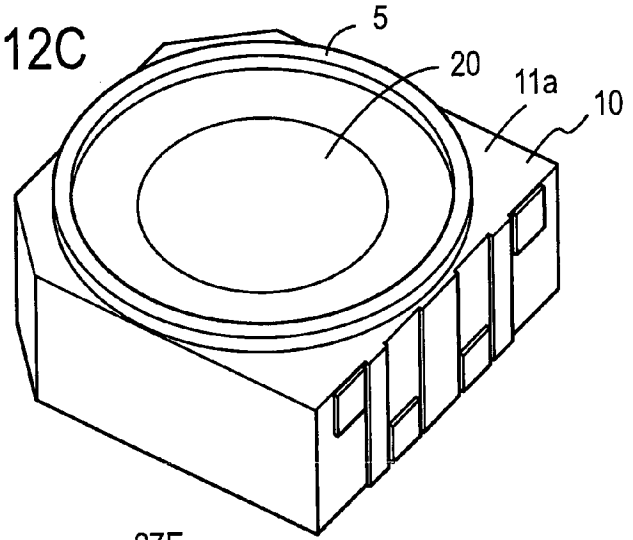
FIG. 12C is a perspective view of the upper part of the holder to which the microphone main body of FIG. 12A is attached.
Figure 12D:
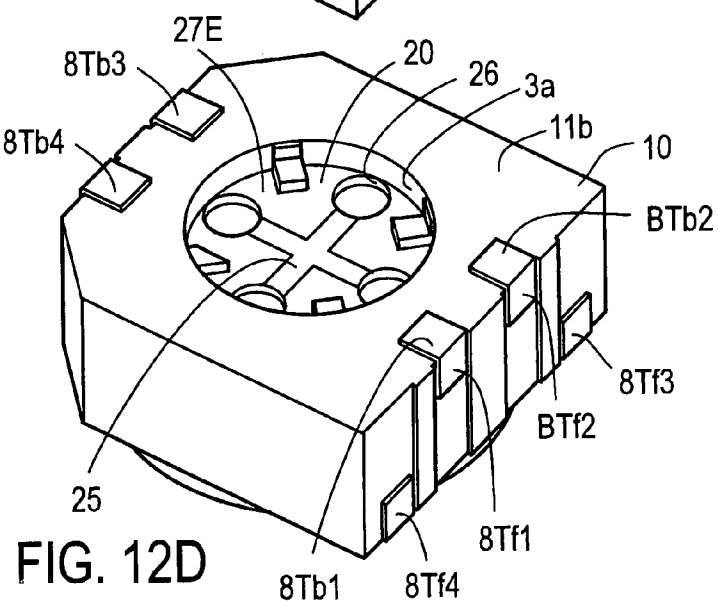
FIG. 12D is a perspective view of the lower part of the holder to which the microphone main body of FIG. 12A is attached.
Figure 12A:
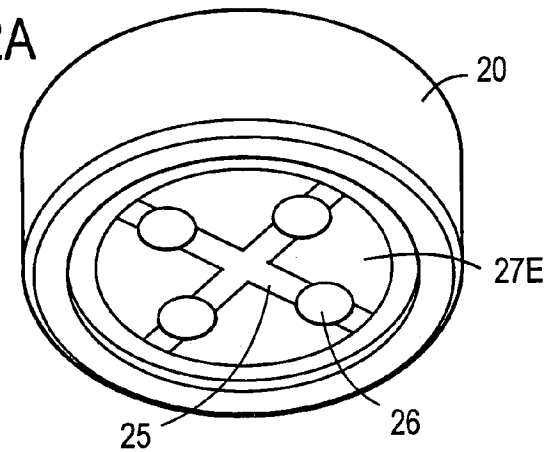
FIG. 12A is a perspective view of a microphone main body having acoustic holes formed on the terminal electrode side.
Figure 12B:
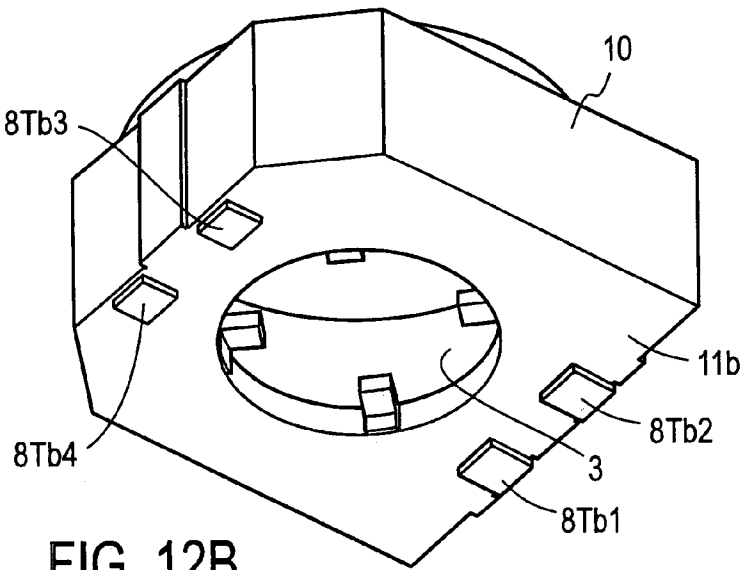
FIG. 12B is a perspective view of the holder.

In the first embodiment described above, the holder 10 is a massive heat-resistant elastic material, and a silicon rubber is used for the material, but a heat-resistant resin may be used in stead of the heat-resistant elastic material. In this case, the sealing portion 5 is desirably an elastic material in terms of a function as a seal for an acoustic space. Therefore, FIG. 10 illustrates a structure in which the holder 10 is composed of the sealing portion 5 and the other portion (called a housing main body 10' in this case) separately of each other, and these portions are connected to be integrated. Namely, FIG. 10 shows a structure in which the sealing portion 5 composed of, for example, a silicon rubber and having a flange portion 5*a*, is placed on the front face of the housing main body 10' composed of a heat-resistant resin such as, for example, polybutylene terephtanol or a liquid crystal polymer. FIGS. 11A and 11B show an exploded perspective view and an exploded front view of the holder 10 of FIG. 10. In FIGS. 11A and 11B, the sealing portion 5 including the flange portion 5*a* has a size allowing the sealing portion 5 to fit into the housing chamber 3 of the housing main body 10', in other words, a size allowing the sealing portion 5 to be stuck on the front face of the microphone main body 20. The sealing portion 5 is placed to surround the acoustic holes 26 of the microphone main body 20 with the sealing portion 5 stuck on the microphone main body 20. In this example, the sealing portion 5 is stuck on the microphone main body 20, but the sealing portion 5 may be stuck on the front face 11*a* of the housing main body 10' to surround the periphery of the housing chamber 3.

Third Embodiment

FIGS. 12A to 12D show a third embodiment. In this embodiment, the acoustic holes 26 are formed on the board 25 on which terminal electrodes 27E of the microphone main body 20 are formed. The structure of the holder 10 is same as the structure in which the mounting electrodes 8Tf1 and 8Tf2 are placed on the back face 11*b* side and the mounting electrodes 8Tf3 and 8Tf4 are placed on the front face 11*a* side on the rear end face 11*f* except for the mounting electrodes 8Ta1 to 8Ta4 on the front face 11*a* side in FIGS. 3, 4A to 4E. Thus, the terminal electrodes 27E of the microphone main body 20 and the acoustic holes 26 are situated on the back face 11*b* side of the holder 10. In the example of FIGS. 12A to 12D, the sealing portion 5 may be formed on the periphery of the housing chamber 3 on the back face 11*b* side of the holder 10. Needless to say, if the holder 10 is formed with an elastic material such as a silicon rubber, the acoustic space formed inside the hole 3*a* and in front of the board 25 having the acoustic holes 26 can be sealed by pressing the back face 11*b* of the holder 10 tightly to a surface of a circuit board on which the microphone assembly is mounted, even if no sealing portion is formed on the back face 11*b* of the holder 10.

In the foregoing explanations, a sealing portion is provided for preventing stray noises, but if a low-hardness material is used as the elastic material for the holder 10, sealing can be achieved without the sealing portion 5 by pressing one of the faces of the holder 10 tightly to the surface of a circuit board on which the microphone assembly is mounted.

In the present invention, if a plurality of holders are aligned to be assembled with microphone main bodies, namely by introducing so called a "tape and reel", automatic successive mounting can be achieved. By placing the microphone assemblies 32 on the tape and reel, the microphone assemblies 32 can automatically be mounted on the circuit boards of mobile phones or the like, successively.

The above example of the microphone with a holder has been described for mobile phones, but the microphone with a holder can be applied for small-sized information communicating devices such as a PDA, digital cameras and the like.

Fourth Embodiment

In the first to third embodiments described above, the microphone is used as an electro-acoustic transducer, but other types of electro-acoustic transducers can be applied as will be described below.

Figure 13A:
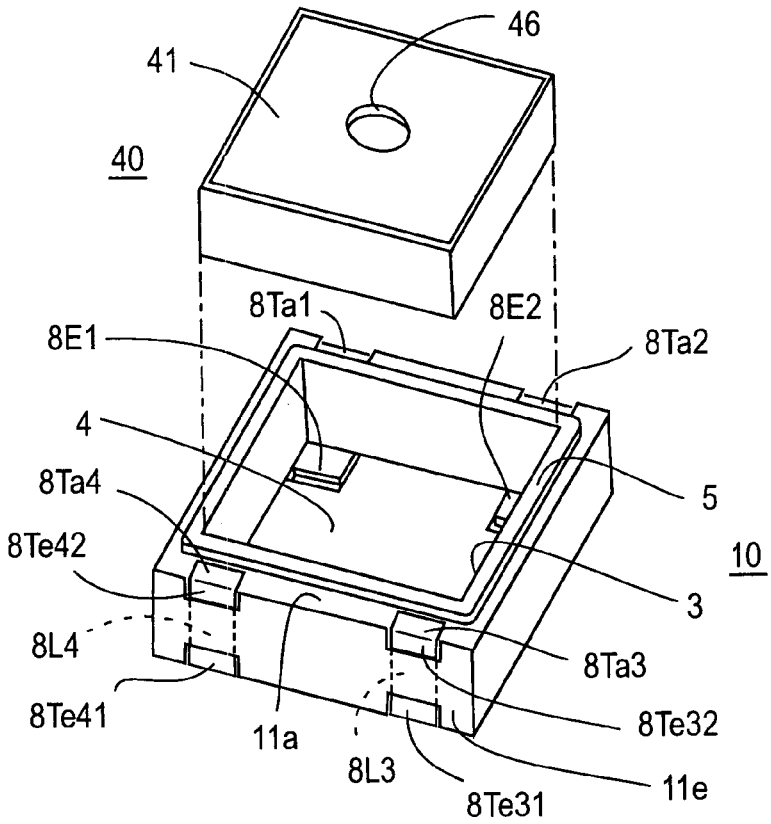
FIG. 13A is a perspective view of a sounder and holder where a sounder is used as an electro-acoustic transducer.
Figure 13B:
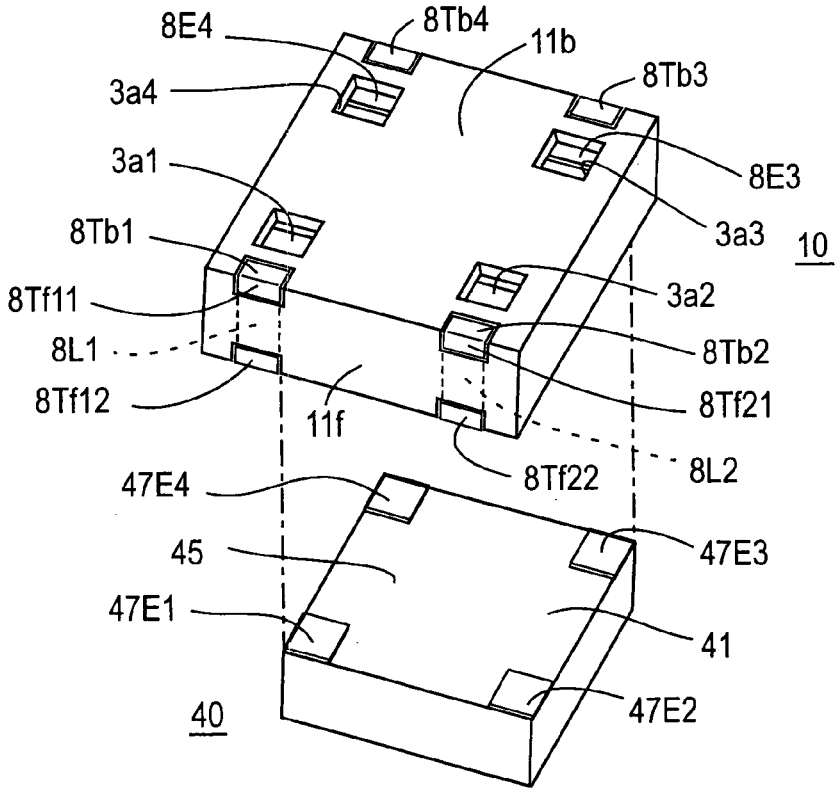
FIG. 13B is a perspective view showing the sounder and holder of FIG. 13A with the figure flipped from top to bottom.

FIG. 13A shows separately a sounder 40 and the holder 10 constituting a sounder with a holder where the present invention is applied using as an electro-acoustic transducer, a sounder which generates simple sounds other than voices or musical sounds, and FIG. 13B shows a view of FIG. 13A flipped upside down. A case 41 of the sounder 40 is formed with a heat-resistant resin into a rectangular parallelepiped shape, and an acoustic hole 46 is formed at the center on the top face. Terminal electrodes 47E1 to 47E4 are provided at four corners of a board 45 forming the back face of the case 41. Two terminals are enough for driving the sounder 40 with electric signals, but four terminal electrodes 47E1 to 47E4 are provided for improving the balance. Among these electrodes, for example, the terminal electrodes 47E1 and 47E2, and the terminal electrodes 47E3 and 47E4 are mutually connected by wiring portions inside the case 41.

The holder 10 is formed into a block shape in accordance with the shape of the sounder 40, the quadrangle housing chamber 3 housing the sounder 40 is formed to extend from the top face 11*a* to the back face 11*b*. The quadrangle sealing portion 5 surrounding the housing chamber 3 and raised upward is formed on the top face 11*a*. The housing chamber 3 is closed on the back face 11*b* side by the bottom wall 4, quadrangle holes 3*a*1 to 3*a*4 are formed in the bottom wall 4, and the connection electrodes 8E1 to 8E4 to be soldered to the terminal electrodes 47E1 to 47E3 of the sounder 40 are placed above the quadrangle holes 3*a*1 to 3*a*4. In this example, mounting electrodes are provided on respective faces so that the holder 10 can be attached to an electronic device at any of the top face 11*a*, the back face 11*f*, the front end face 11*e* and the rear end face 11*f* of the holder 10. Specifically, the mounting electrodes 8Ta1 to 8Ta4 are provided on the top face 11*a*, the mounting electrodes 8Te31, 8Te32, 8Te41 and 8Te42 are provided on the front end face 11*a*, the mounting electrodes 8Tf11, 8Tf12, 8Tf21 and 8Tf22 are provided on the rear end face 11*f*, and the mounting electrodes 8Tb1 to 8Tb4 are provided on the back face 11*b*.

As is understood from FIGS. 13A and 13B, the connection electrode 8E1 is derived to the back face 11*b* and bent along the back face 11*b* to form the mounting electrode 8Tb1. An extended portion of the mounting electrode 8Tb1 is bent at the back face 11*f* to form the mounting electrode Tf11. Further, the mounting electrode 8Tf11 is bent, then extends through the wall as the wiring portion 8L1 shown by broken lines, and is derived to the back face 11*f* again to form the mounting electrode 8Tf12, and the mounting electrode 8Tf12 is bent at the top face 11*a* to form the mounting electrode 8Ta1. A set of the electrodes 8Tf11, 8Tf12, 8Ta1, 8Tb1 and 8E1 and the wiring portion 8L1 is integrally formed from a metal plate by a process of punching/bending, and attached to the holder 10 by insert molding. A set of the other electrodes 8Tf21, 8Tf22, 8Ta2, 8Tb2 and 8E2 and the wiring portion 8L2, a set of the electrodes 8Te31, 8Te32, 8Tb3 and 8E3 and the wiring portion 8L3, and a set of the electrodes 8Te41, 8Te42, 8Ta4, 8Tb4 and 8E4 and the wiring portion 8L4 are integrally formed in the same manner.

Since the terminal electrodes 47E1 and 47E4 of the sounder 40 are mutually connected, and the electrodes 47E2 and 47E3 are mutually connected, the electrodes 8Tb1, 8Tf11, 8Tf12 and 8Ta1 and the electrodes 8Tb4, 8Te41, 8Te42 and 8Ta4 of the holder 10 are mutually electrically connected, and the electrodes 8Tb2, 8Tf21, 8Tf22 and 8Ta2 and the electrodes 8Tb3, 8Te31, 8Te32 and 8Ta3 are mutually electrically connected when the sounder 40 is incorporated in the holder 10. Thus, at least two electrically isolated electrodes are provided on any of the top face 11*a*, the back face 11*b*, the front end face 11*e* and the rear end face 11*f*, and the sounder with a holder can be attached to an electronic device at any of the faces.

Figure 14A:
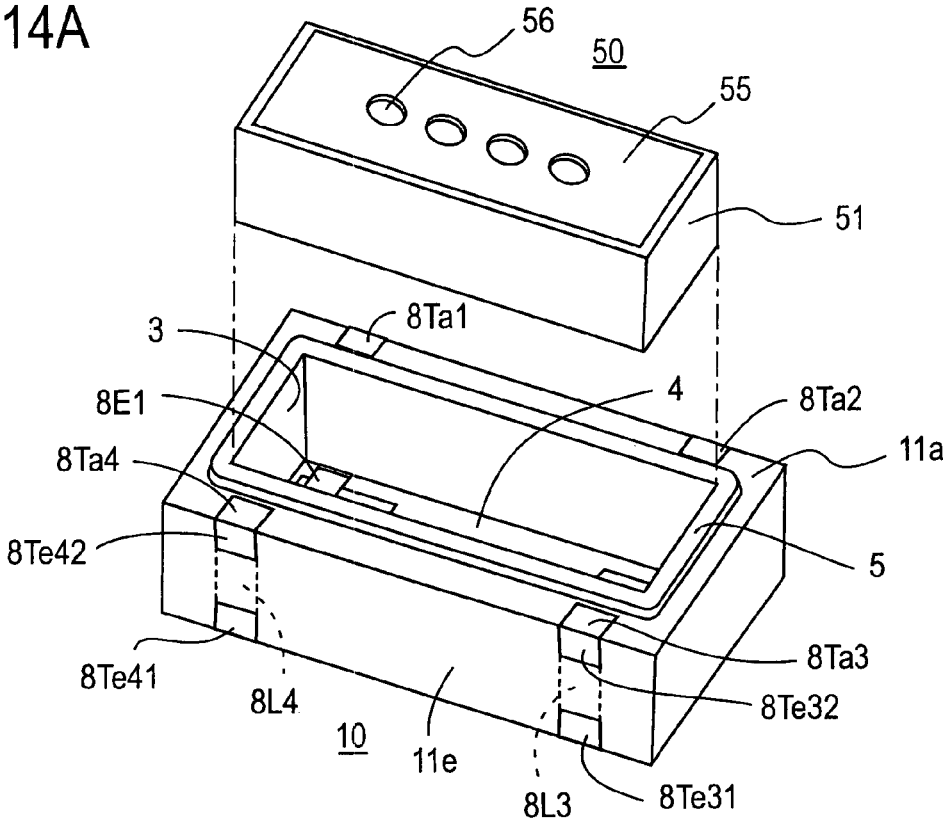
FIG. 14A is a perspective view of a receiver and holder where a receiver is used as an electro-acoustic transducer.
Figure 14B:
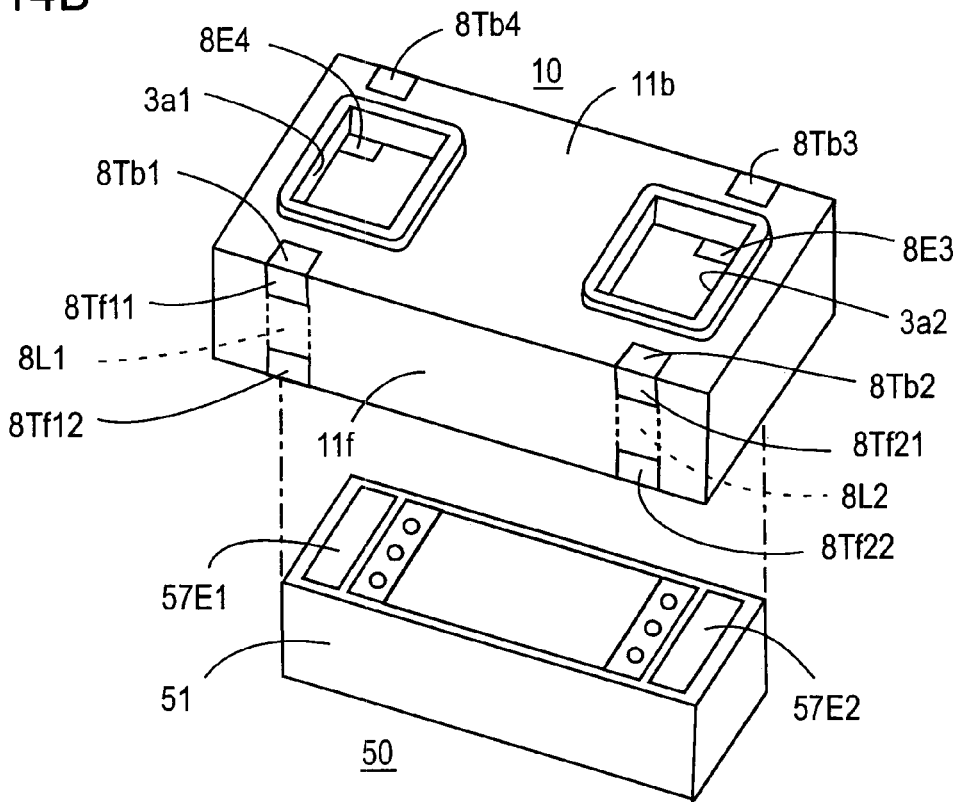
FIG. 14B is a perspective view showing the receiver and holder of FIG. 14A with the figure flipped from top to bottom.

FIG. 14A shows separately a receiver 50 and the holder 10 constituting a receiver with a holder where the present invention is applied using, as an electronic-acoustic transducer, a receiver (a small-sized speaker for use in a head set or the like) regenerating voices and musical sounds, FIG. 14B shows a view of FIG. 14A flipped upside down. A case 51 of the receiver 50 is formed with a heat-resistant resin into a slender rectangular parallelepiped shape, and a plurality of acoustic holes 56 aligning along the longer side are formed at the center of the top face of the rectangular. On a board 55 on the back face of the case 51, terminal electrodes 57E1 and 57E2 are provided at opposite ends of the board 55 in the longer side direction.

The holder 10 is a slender block in which the quadrangle housing chamber 3 is formed in accordance with the shape of the receiver 50, and two holes 3*a*1 and 3*a*2 aligning along the longer side are formed on the bottom wall 4. The configuration and arrangement of the connection electrodes 8E1 to 8E4, the mounting electrodes 8Ta1 to 8Ta4, 8Tb1 to 8Tb4, 8Tf11, 8Tf12, 8Tf21, 8Tf22, 8Te31, 8Te32, 8Te41 and 8Te42, the wiring portions 8L1 to 8L4 and the like are similar to those in the example of the holder 10 in FIGS. 13A and 13B, and therefore explanations thereof are not presented.

The receiver with a holder can be attached to an electronic device at any of the top face 11*a*, the back face 11*b*, the front end face 11*e* and the rear end face of the holder 10.

As described above, according to the present invention, a plurality of mounting electrodes connected to a plurality of terminal electrodes of the electro-acoustic transducer are provided on each of at least two faces of the holder, and therefore the electro-acoustic transducer can be attached at any one of at least two faces, and resultantly, a universal microphone accommodating various position changes can be obtained.

What is claimed is:

1. An electro-acoustic transducer with a holder comprising:

an electro-acoustic transducer having a plurality of terminal electrodes;

a block-shaped holder which has a plurality of faces and in which a housing chamber is formed having an opening on one of the faces and a bottom wall facing the opening, wherein the block-shaped holder houses said electro-acoustic transducer;

a plurality of connection electrodes provided on a surface of the bottom wall of said housing chamber and connected to said plurality of terminal electrodes, respectively;

a plurality of mounting electrodes provided on a first face and a second face of said plurality of faces of said holder in correspondence with said plurality of connection electrodes, respectively, wherein each of said first and second faces has a plurality of mounting electrodes adjoining a first edge of a respective face and a plurality of mounting electrodes adjoining a second edge of the respective face, and wherein the first edge is opposite the second edge; and wiring portions provided on said holder, each for electrically connecting a mounting electrode on said first face with a corresponding one of said connection electrodes and to a corresponding one of said mounting electrodes on said second face.

2. The electro-acoustic transducer with a holder according to claim 1, wherein each of said connection electrodes, said corresponding ones of said mounting electrodes on said plurality of faces, and said wiring portion electrically connecting said each connection electrode and said corresponding ones of said mounting electrodes are integrally formed in one piece.

3. The electro-acoustic transducer with a holder according to claim 2, wherein said wiring portions are embedded under a surface of said holder.

4. The electro-acoustic transducer with a holder according to claim 1, wherein an elastic sealing portion saliently formed to surround said housing chamber is provided on said one of the faces.

5. The electro-acoustic transducer with a holder according to claim 4, wherein said holder and said sealing portion are integrally formed with a rubber material.

6. The electro-acoustic transducer with a holder according to claim 4, wherein said sealing portion is formed with a rubber material, and said holder is formed with a heat-resistant resin.

7. The electro-acoustic transducer with a holder according to claim 1, 2 or 4, wherein said electro-acoustic transducer is a microphone.

8. The electro-acoustic transducer with a holder according to claim 1, 2 or 4, wherein said electro-acoustic transducer provides acoustic output.

9. The electro-acoustic transducer with a holder according to claim 1, 2 or 4, wherein said electro-acoustic transducer receives acoustic input.

10. The electro-acoustic transducer with a holder according to claim 1, 2 or 4, wherein said first and second faces are opposite to one another.

* * * * *